US005297629A

United States Patent [19]

Barrington et al.

[11] Patent Number: 5,297,629

[45] Date of Patent: Mar. 29, 1994

[54] DRILL STEM TESTING WITH TUBING CONVEYED PERFORATION

[75] Inventors: Burchus Q. Barrington, Duncan, Okla.; Flint R. George, Katy, Tex.

[73] Assignee: Halliburton Company, Duncan, Okla.

[21] Appl. No.: 824,427

[22] Filed: Jan. 23, 1992

[51] Int. Cl.[5] ..... E21B 43/116; E21B 34/12; E21B 33/128; E21B 49/08

[52] U.S. Cl. ..... 166/297; 166/55.1; 166/128; 166/152; 166/324; 166/326; 166/332

[58] Field of Search ..... 166/128, 152, 126, 142, 166/326, 324, 332, 297, 55.1

[56] References Cited

U.S. PATENT DOCUMENTS

| | | | |
|---|---|---|---|
| 3,211,229 | 10/1965 | Bramlett | 166/128 |
| 3,570,595 | 3/1971 | Berryman | 166/128 |
| 3,997,009 | 12/1976 | Fox | 166/326 X |
| 4,258,793 | 3/1981 | McGraw et al. | 166/315 |
| 4,484,632 | 11/1984 | Vann | 166/297 |
| 4,541,486 | 9/1985 | Wetzel et al. | 166/297 |
| 4,544,034 | 10/1985 | George | 166/297 |
| 4,564,076 | 1/1986 | Vann et al. | 175/4.52 |
| 4,590,995 | 5/1986 | Evans | 166/128 X |
| 4,614,156 | 9/1986 | Colle, Jr. et al. | 102/312 |
| 4,638,859 | 1/1987 | Zimkel et al. | 166/126 X |
| 4,804,044 | 2/1989 | Wesson et al. | 166/297 |
| 4,880,056 | 11/1989 | Nelson et al. | 166/142 X |
| 4,915,171 | 4/1990 | McMahan | 166/264 |

OTHER PUBLICATIONS

Exhibit A—Halliburton Services Sales & Service Catalog No. 43 (1985), p. 2549; Exhibit B, p. 2544; Exhibit C, pp. 2564–2565.

Exhibit D—Vann Systems brochure TCP-1006.

Exhibit E-Vann Systems brochure TCP-1002.

Exhibit F-Vann Systems brochure TCP-1013.

Exhibit G—Vann Systems brochure TCP-1020.

*Primary Examiner*—Hoang C. Dang

*Attorney, Agent, or Firm*—Tracy W. Druce; Lucian Wayne Beavers

[57] ABSTRACT

A well test string includes an annulus pressure responsive tester valve and a tubing conveyed perforating gun including a tubing pressure actuated time delay firing mechanism. A compression set packer is disposed in the test string between the tester valve and the perforating gun. The packer includes a bypass valve for communicating the well below the packer with the tubing bore. The bypass valve is operably associated with the packer so that the bypass valve is open prior to setting the packer and so that the bypass valve is closed as the packer is set. The compression set packer also includes a one-way equalizer valve for allowing one-way fluid flow from the well below the packer to the tubing bore. The equalizer valve is operably associated with a bypass valve so that the equalizer valve is inoperable when the bypass valve is open, and so that the equalizer valve is operable when the bypass valve is closed.

16 Claims, 4 Drawing Sheets

DRILL STEM TESTING WITH TUBING CONVEYED PERFORATION

BACKGROUND OF THE INVENTION

1. Field Of The Invention

The present invention relates generally to a drill stem test string including tubing conveyed perforating guns, and more particularly, but not by way of limitation, to an adapter for a compression set packer which allows the combination of a drill stem test string with a tubing conveyed perforating string.

2. Description Of The Prior Art

During the completion of a well it is desirable to flow test the well after the well is perforated. It is particularly desirable to be able to flow test the well in an unbalanced condition wherein the pressure in the well is substantially lower than the formation pressure when the subsurface formation is initially perforated.

One system which accomplishes this general purpose is that shown in U.S. Pat. No. 4,915,171 to McMahan, and assigned to the assignee of the present invention. The McMahan patent discloses an above packer perforate test and sample tool which allows well annulus pressure above the packer to cross over into the tubing string to actuate a pressure actuated firing mechanism for the tubing conveyed perforating guns.

U.S. Pat. No. 4,804,044 to Wesson et al., and assigned to the assignee of the present invention, discloses another system which operates in a manner somewhat similar to the McMahan '171 patent.

The prior art also includes a compression set packer actuated by setting down weight on the packer. One example of such a tool is that sold by Halliburton Services, the assignee of the present invention, under the trademark Champ® III Packer. The details of construction of the Champ® III Packer

SUMMARY OF THE PRESENT INVENTION

The present invention provides an adapter which can be added to a Champ®III Packer to connect a conventional tubing conveyed perforating string therebelow while allowing use of a conventional drill stem test string thereabove.

The modified packer includes a packer body assembly with a compression packer element disposed about the packer body assembly. An actuating mandrel is reciprocably received in the packer body assembly for expanding the compression packer element to seal against a well bore when weight from a tubing string thereabove is set down on the packer mandrel. The packer mandrel has a central flow passage defined therethrough which is adapted to be communicated with a tubing bore of the tubing string.

A bypass valve is provided for communicating the well below the compression packer element with the central flow passage of the packer mandrel and thus with the tubing bore. The bypass valve is operably associated with the packer mandrel so that the bypass valve is open prior to setting the packer and so that the bypass valve is closed as the packer is set to seal the compression packer element against the well bore.

A one-way equalizer valve is also operably associated with the packer mandrel for allowing one-way fluid flow from the well below the compression packer element to the central flow passage of the packer mandrel to equalize well pressure and tubing pressure after weight is set down on the packer apparatus.

This apparatus is preferably used with a drill stem test string including an annulus pressure responsive tester valve disposed above the packer. The tubing conveyed perforating string connected below the packer preferably includes a tubing pressure actuated time delay firing mechanism.

With this overall arrangement, the test string is run into a well and then weight is set down on the test string thereby setting the compression set packer to isolate an upper well annulus from a lower portion of the well. When the packer is set, the bypass is closed and the one-way equalizer valve means is placed in an operating position.

Then, well fluid pressure in the upper well annulus is increased to open the annulus pressure responsive tester valve.

After the tester valve is opened, tubing fluid pressure can be increased down the tubing bore through the tester valve to actuate the firing mechanism of the tubing conveyed perforating guns without increasing well fluid pressure in the lower portion of the well.

Then, during the time delay provided prior to the firing of the guns, tubing fluid pressure is reduced thus equalizing well fluid pressure in the lower portion of the well with the reduced tubing fluid pressure through the one-way equalizer valve means.

Then the perforating guns fire to perforate the lower portion of the well and to communicate a subsurface hydrocarbon producing formation with the well in an underbalanced condition.

Numerous objects, features and advantages of the present invention will be readily apparent to those skilled in the art upon a reading of the following disclosure when taken in conjunction with the accompanying drawings.

Figure 1A:
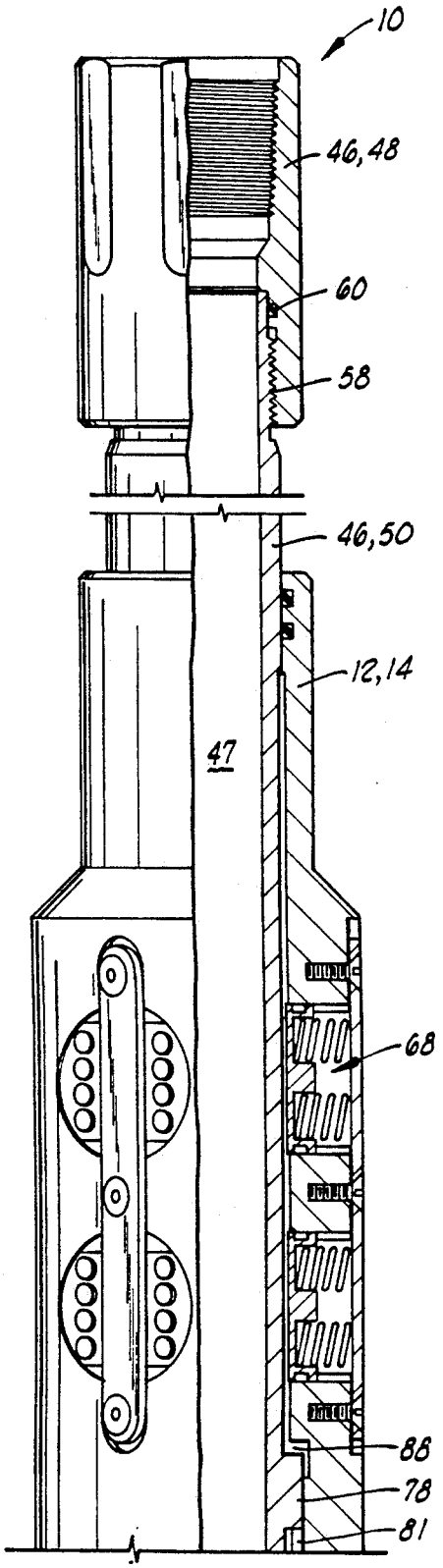
FIG. 1A PRIOR ART
FIGS. 1A-1D comprise an elevation partially sectioned view of a prior art Halliburton Champ® III Packer.

DETAILED DESCRIPTION OF THE PREFERRED EMBODIMENTS DESCRIPTION OF THE PRIOR ART CHAMP® III PACKER

FIGS. 1A-1D illustrate the prior art Halliburton Champ® III Packer prior to modification in accordance with the present invention. The packer in FIGS. 1A-1D is generally designated by the numeral 10.

The packer 10 includes a packer body assembly generally designated by the numeral 12. The packer body assembly 12 includes a hydraulic hold down slip body 14, an upper body 16, a shoe coupling 18, a packer mandrel 20, a mechanical slip body 22, a split ring collar 41, and drag block sleeve 42.

Hydraulic hold down slip body 14 and upper body 16 are threadedly connected at 24 with an O-ring seal 2 provided therebetween. Upper body 16 and shoe coupling 18 are threadedly connected at 28.

Shoe coupling 18 has a plurality of radially inward extending splines 30 which mesh with radially outward extending splines 32 of packer mandrel 20 so that shoe coupling 18 can slide downward relative to packer mandrel 20.

Packer mandrel 20 is threadedly connected to mechanical slip body 22 at thread 34 with an O-ring seal 36 provided therebetween.

The mechanical slip body has a downward tapered surface 38 which engages a mechanical slip assembly generally designated by the numeral 40. The lower end of the mechanical slip assembly 40 is slidingly connected to split ring collar 41 which is connected to drag block sleeve 42 which carries a plurality of spring biased drag blocks 44.

A compression packer element 21 is disposed about packer mandrel 20 between the shoe coupling 18 and the mechanical slip body 22. Compression packer element 21 includes first, second and third packer rings 23, 25 and 27. In a manner further described below, when the shoe coupling 18 moves downward relative to packer mandrel 20 the compression packer element 21 is compressed between shoe coupling 18 and mechanical slip body 22 to radially expand the compression packer element 21 so that it seals against casing bore 154 (see FIG. 4).

An actuating mandrel assembly is reciprocably received within the packer body assembly 12. The actuating mandrel assembly is generally designated by the numeral 46. The actuating mandrel assembly 46 includes an upper adapter 48, an upper mandrel 50, a balancing coupling 52, a center mandrel 54, and a lower mandrel 56. The actuating mandrel assembly 46 has a central flow passage 47 defined therethrough which can also be generally described as a mandrel bore 47.

Upper adapter 48 and upper mandrel 50 are threadedly connected at 58 with an O-ring seal 60 therebetween. The balancing coupling 52 is threadedly connected to upper mandrel

50 and center mandrel 54 at threads 62 and 64, respectively. Center mandrel 54 and lower mandrel 56 are threadedly connected at thread 66.

Hydraulic hold down slip body 14 carries a plurality of hydraulically actuated hold down slips generally designated as 68.

A floating piston 70 is received between and slidably sealingly engages both the balancing coupling 52 and the upper body 16.

Figure 1B:
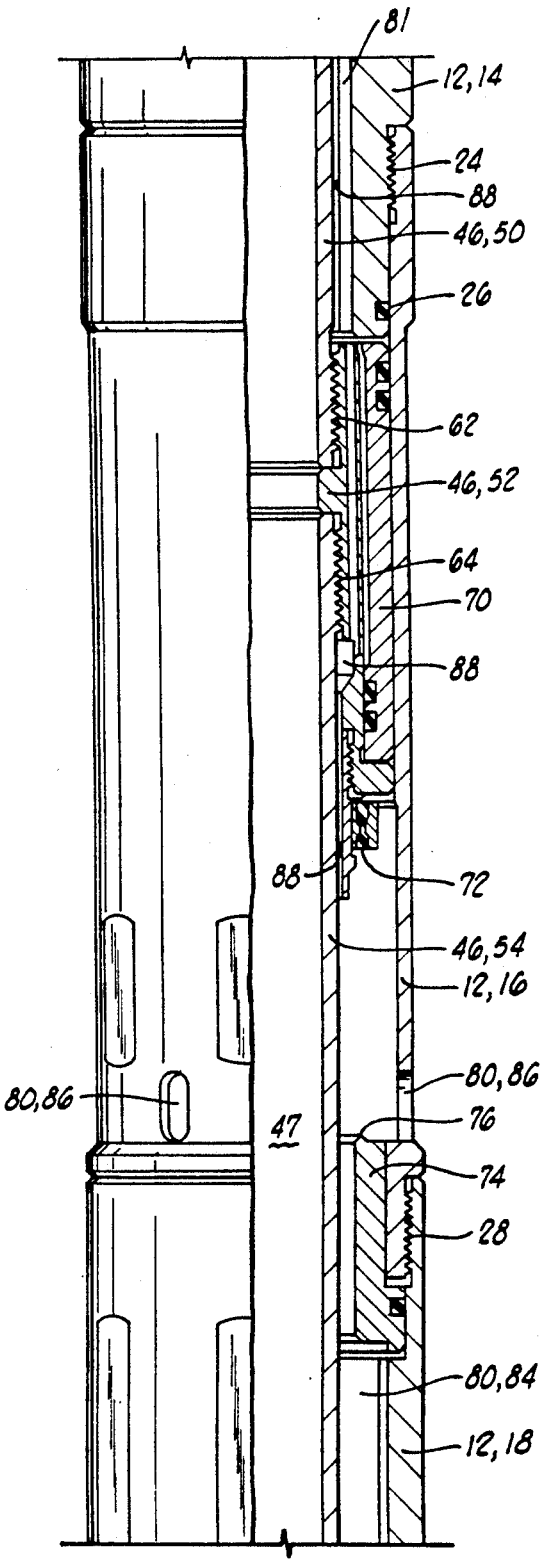
FIG. 1B PRIOR ART
Figure 1C:
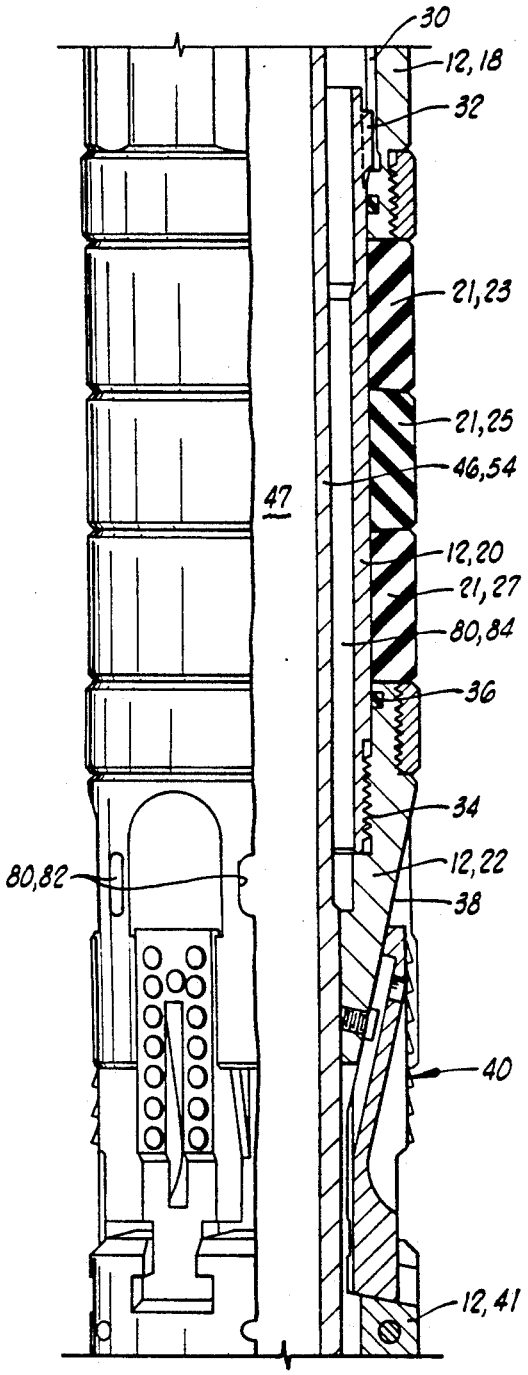
FIG. 1C PRIOR ART
Figure 1D:
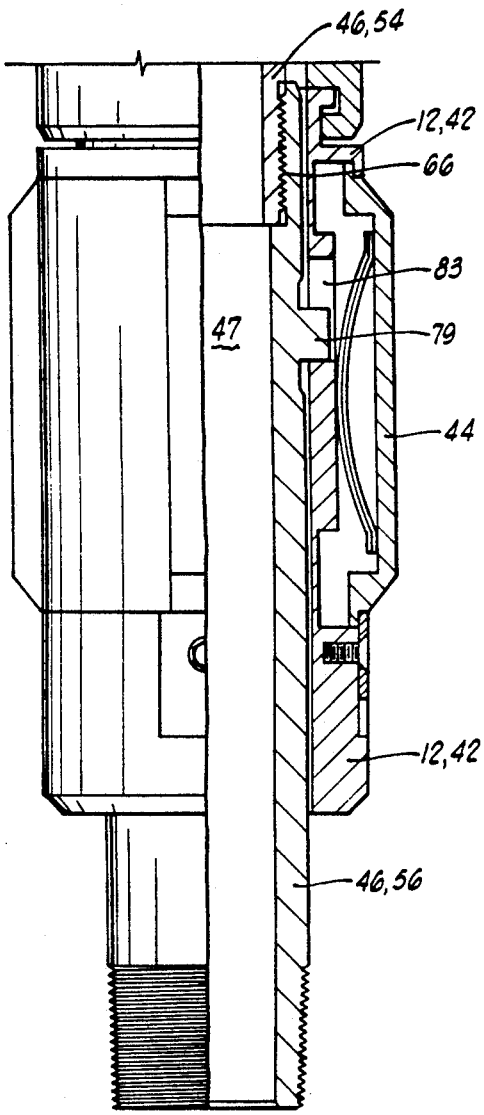
FIG. 1D PRIOR ART

The balancing coupling 52 carries an annular bypass seal 72 on its lower end as seen in FIG. 1B. A face seal sleeve 74 is held in place between upper body 16 and shoe coupling 18 and has an annular knife edge 76 defined on the upper end thereof.

Upper mandrel 50 carries a radially outward extending lug 78 which is received in a J-slot 81 defined in hydraulic hold down slip body 14. Lug 78 is shown in FIG. IA in an uppermost position corresponding to an initial position of the packer 10 in which the packer 10 can be run into the well. When it is desired to set the packer 10, the actuating mandrel assembly 48 is rotated clockwise and weight is set down thereon to move the lug ·78 downward through J-slot 81 relative to the packer body assembly 12.

Similarly a second lug 79 is defined on lower mandrel 56 and cooperates with a similarly shaped J-slot 83 defined in the drag block sleeve 42.

The packer 10 includes a well annulus bypass passage 80 including lower inlets 82, an annular cavity 84 defined between actuating mandrel assembly 46 and packer body assembly 12, and a plurality of upper outlets 86 defined through upper body 16 The well annulus bypass passage allows well fluid in the well annulus surrounding packer 10 to flow in inlets 82 up through annular cavity 84 and out outlets 86 so that the well fluid can bypass the compression packing element 21 to prevent a piston effect as the packer 10 is run into the well.

When the packer apparatus 10 is set by setting weight down to move the actuating mandrel assembly 46 downward relative to packer body assembly 12, the annular bypass seal 72 will engage the knife edge 76 to close the well annulus bypass passage 80. The weight which is set down on the actuating mandrel assembly 46 is transferred from the annular bypass seal 72 to the face seal sleeve 74 and thus to the shoe coupling 18.

The drag blocks 44 initially resist downward movement of the packer body assembly 12, and thus the shoe coupling 18 will begin to slide downward relative to packer mandrel 20 thus beginning to compress the compression packing element 21. As this compression load is transferred to mechanical slip body 22, the tapered surface 38 thereof will cam the mechanical slip assemblies 40 outward into gripping engagement with the casing bore 154 so as to securely anchor the slip assemblies 40 against any downward movement relative to the well casing. Continued downward application of force on the shoe coupling 18 will cause the compression packer element 21 to be squeezed radially outward to seal against the well casing bore 154.

Even after the well annulus bypass passage 80 has been closed, fluid pressure from below the compression packing element 21 is still communicated to the hydraulic actuated hold down slips 68 through fluid passage 88. This fluid pressure will cause the hydraulically actuated hold down slips 68 to extend radially outward into engagement with the well casing bore 154 to prevent any upward forces which might later be created across the packer 10 from moving the packer 10 upward relative to the casing bore.

The Modifications To The Halliburton Champ® III Packer

Figure 2A:
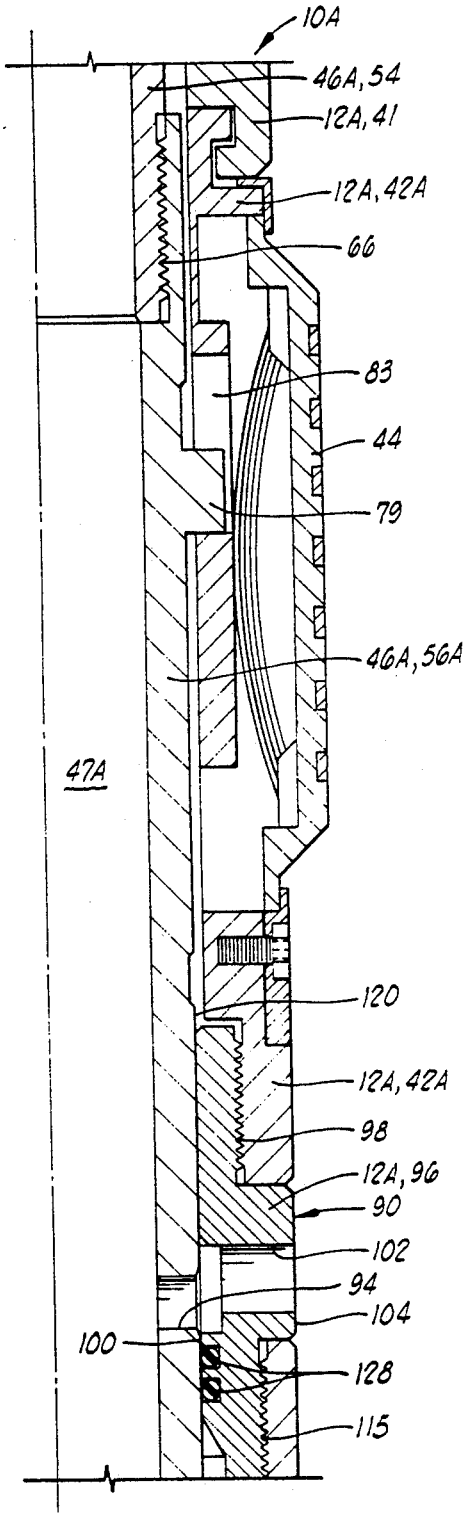
FIGS. 2A and 2B comprise an elevation right side only sectioned view of a modified lower portion of the packer of FIGS. 1A-1D incorporating a bypass valve and a one-way equalizer valve.
Figure 2B:
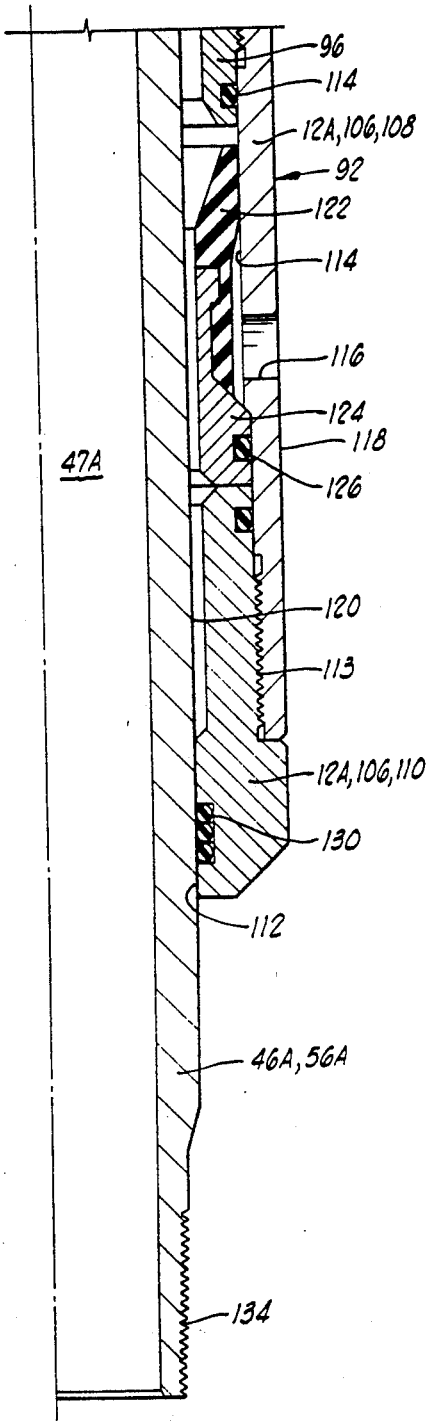

In FIGS. 2A–2B an elevation right side only sectioned view is shown of the lower portion of a modified packer similar to that of FIGS. 1A–1B. The modified packer is generally designated by the numeral 10A. Components analogous to those of the apparatus 10 but modified in some form are designated by the suffix A. For example, the actuating mandrel assembly is now designated as 46A, and the lower mandrel thereof is now designated as 56A. Similarly, the packer body assembly 12 is now designated as 12A, and includes the drag block sleeve which has been modified and is now designated as 42A.

The packer 10A has been modified by adding a bypass valve means generally designated by the numeral 90 and a one-way equalizer valve means generally designated by the numeral 92. Further, the lower mandrel 56A has been extended so that it extends downward through both the bypass valve means 90 and one-way equalizer valve means 92, and additionally a mandrel port 94 has been added to the lower mandrel 56A and cooperates with and forms a part of the bypass valve means 90 and one-way equalizer valve means 92.

The bypass valve means 90 includes a bypass valve housing 96 which forms a portion of the packer body assembly 12A and which is threadedly connected to drag block sleeve 42A at thread 98.

Bypass valve housing 96 has a bypass valve housing bore 100 defined therethrough, and has a plurality of bypass ports 102 which communicate the bypass valve housing bore 100 with an exterior 104 of bypass valve housing 96 and thus with a lower portion 178 (see FIG. 4) of the well 150 surrounding the apparatus 10A.

The one-way equalizer valve means 92 includes an equalizer valve housing 106 having an upper portion 108 and a lower portion 110, which portions are threadedly connected together at 113. The equalizer valve housing 106 is threadedly connected to a lower end of bypass valve housing 96 at threaded connection 115 with an O-ring seal 114 defined therebetween.

The equalizer valve housing 106 can also be considered to be a part of the packer body assembly 12A.

The equalizer valve housing 106 has an equalizer valve housing bore 112 defined therethrough and aligned with the bypass valve housing bore 100. The equalizer valve housing 106 has an enlarged diameter counterbore 114 located above the equalizer housing bore 112 and below the bypass valve housing bore 100. Equalizer valve housing 106 has a plurality of equalizer ports 116 communicating the enlarged diameter counterbore 114 with an exterior 118 of equalizer valve housing 106 and thus with the well surrounding apparatus 10A.

The lower mandrel 56A of actuating mandrel assembly 46A can also be described as an actuating mandrel extension 56A which has a cylindrical outer surface 120 which is closely received in the bypass valve housing bore 100 and the equalizer valve housing bore 112.

The mandrel port 94 extends radially through lower mandrel 56A and communicates the cylindrical outer surface 120 with the mandrel bore or central flow passage 47A.

An annular elastomeric flapper valve element 122 is disposed in the enlarged counterbore 114 of equalizer valve housing 106 Flapper valve element 122 is carried by annular ring 124 which carries a seal 126 which seals against equalizer valve housing 106. The flapper valve 122 is constructed so that in its natural relaxed position it engages the counterbore 114 as shown above the equalizer port 116 so that the equalizer port 116 will be closed against any outward flow therethrough. If, however, outside fluid pressure exceeds that within the equalizer valve housing 106, the flapper valve element 108 can allow inward flow through the equalizer port 116 in a manner further described below.

Upper and lower annular seals 128 and 130 seal between the cylindrical exterior surface 120 of lower mandrel 56A and the bypass valve housing bore 100 and the equalizer valve housing bore 112, respectively.

The lower mandrel 56A is shown in FIGS. 2A–2B in a first position corresponding to the initial unset position of packer 10A. In this first position, the mandrel port 94 is located above upper seals 128 and is communicated with the bypass port 102. Thus, the well fluid pressure surrounding apparatus 10A is continuously equalized with tubing pressure inside the mandrel bore 47A so long as the actuating mandrel assembly 46A is in its initial or first position. In this first position, the one-way equalizing valve means 92 is inoperable since the flapper valve 122 is not communicated with the mandrel bore 47A. When weight is set down on the apparatus 10A to set the compression packing element 21, the actuating mandrel assembly 46A will move downward relative to the packer body assembly 12A to a second position where the mandrel port 94 is located between upper and lower seals 128 and 130 and thus is communicated with the flapper valve element 122. In this second position, further equalization can occur to bleed excess exterior pressures into the mandrel bore 47A and thus into the tubing bore to equalize those pressures as is further described below.

Figure 3:
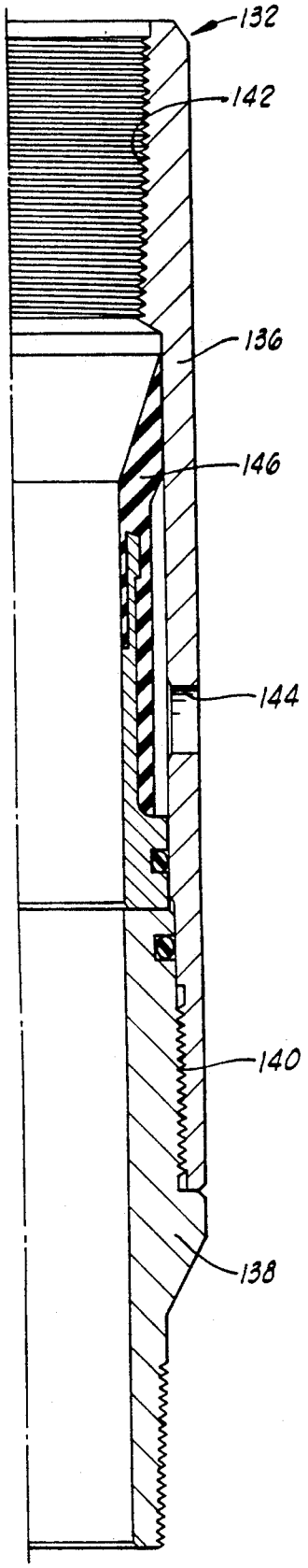
FIG. 3 is an elevation right side only sectioned view of a supplemental one-way equalizer valve which can be connected to the lower end of the apparatus seen in FIG. 2B.

FIG. 3 shows a supplemental one-way equalizer valve generally designated by the numeral 132. The supplemental equalizer valve 132 is designed to be connected to the lower threaded end 134 of lower mandrel 56A to provide additional flow area to supplement the flow area of one-way equalizer valve means 92.

The supplemental equalizer valve 132 includes a supplemental valve housing 136 and a lower adapter 138 threadedly connected at 140. Housing 136 carries an internal thread 142 which makes up with thread 134 of lower mandrel 56A.

Supplemental valve housing 136 includes a plurality of supplemental equalizer ports 144 disposed radially therethrough. An annular elastomeric flapper valve 146 controls inward flow through supplemental equalizer ports 144 and prevents outward flow therethrough in a manner similar to that described above for flapper valve 122

Operation Of The Test String

Figure 4:
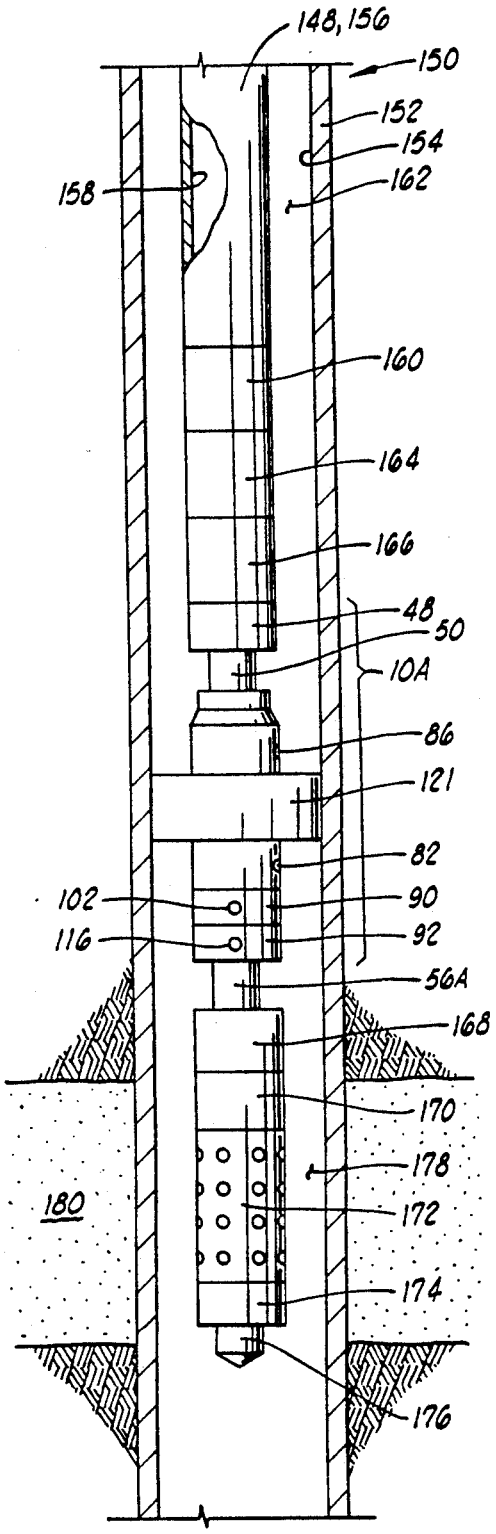
FIG. 4 is an elevation schematic view of a well test string incorporating the present invention.

FIG. 4 schematically illustrates a test string 148 in place within a well 150. The well 150 is defined by a well casing 152 having a casing bore 154 which may also be described as a well bore 154.

The test string 148 includes an elongated string of pipe or tubing which can be generally described as a tubing string 156, having a tubing bore 158 which extends up to the surface for production of fluids in a well known manner.

An annulus pressure responsive tester valve 160 is disposed in the tubing string 156. Tester valve 160 may for example be an LPR-N tester valve available from Halliburton Services of Duncan, Okla. The tester valve 160 contains a spherical ball valve element that can be opened and closed in response to rapid increases and decreases in pressure in a well annulus 162 defined between the tubing string 148 and the casing 152. Located below tester valve 160 is a safety valve or sampler 164. The safety valve/sampler 164 also is preferably an annulus pressure responsive device and may be an APR®-M2 Ful Flo Sampler and Circulating Valve available from Halliburton Services of Duncan, Okla.

Located below the safety/sampler apparatus 164 are one or more hydraulic jars 166.

Connected below the hydraulic jars 166 is the modified packer apparatus 10A of the present invention including bypass valve means 90 and one-way equalizer valve means 92.

Connected below the packer apparatus 10A is a Bar Pressure Vent 168, available from Vann Systems of Houston, Tex., as shown in Vann Systems brochure TCP-1002.

Located below the Bar Pressure Vent 168 is a pressure actuated firing mechanism 170 which may be a Time Delayed Firing Head available from Vann Systems of Houston, Tex., as shown in Vann Systems brochure TCP-1013. The firing mechanism 170 is actuated in response to an increase in pressure within tubing bore 158.

Located below firing mechanism 170 is a perforating gun 172. Additionally blank guns 174 may be located below perforating guns 172 as may a gauge carrier 176. The gauge carrier may also be located above the packer.

In FIG. 4 the compression packing element 121 is shown after it has been expanded to seal against the casing bore 154. This isolates the upper well annulus 162 from a lower portion 178 of the well located below the packing element 121.

It is noted that the perforating guns 172 are located adjacent a subsurface formation 180 which is to be perforated and tested. In FIG. 4, the perforating guns 172 have not yet fired to perforate the casing 152 adjacent subsurface formation 180.

When the packer apparatus 10A is set to expand the compression element 182, the well annulus bypass 80 therethrough closes, as does the bypass port 102 of bypass valve means 90. Simultaneously, the one-way equalizer valve means 92 is made operable.

When the test string 148 is initially run into the well 152, the tester valve 160 is normally in a closed position blocking flow through the tubing bore 158.

After the packing element 121 has been set, by clockwise rotation and setting down weight on the testing string 148 as previously described, well fluid pressure in the upper well annulus 162 will be increased to open the tester valve 160. Then, fluid pressure within the tubing bore 158 can be increased and that increased tubing fluid pressure will be communicated down through the mandrel bore 47A to the time delay firing mechanism 170. This increased tubing pressure can be applied with nitrogen gas. This increased pressure in tubing bore 158 is not communicated at any time to the lower well portion 178 since the flapper valve element 122 will not permit outward flow through equalizing ports 116

The mechanism 170 provides the desired time delay after activation before it fires the perforating guns 172. Mechanism 170 is available in modules each of which provides a seven-minute time delay. The most commonly used time delays are seven minutes or fourteen minutes.

During this delay, the pressure in tubing bore 158 can be reduced. To the extent pressure in the lower well portion 178 exceeds the reduced pressure in tubing bore 158, there will be a flow of fluid inward through equalizing ports 116 to equalize the pressure between lower well portion 178 and tubing bore 158. This equalization is accomplished prior to the time that the perforating guns 172 fire.

This creates what is generally referred to as an unbalanced or underbalanced condition for the perforation of the well. When the perforating gun 172 does fire, it will create a plurality of perforations through well casing 152 thus communicating the subsurface formation 180 with the lower well portion 178. Due to the low pressure, i.e., underbalanced condition, in lower well portion 178 and in tubing bore 158, the formation fluids will rapidly flow inward through the newly created perforations. Those fluids will then flow in through equalizing ports 116 and up the tubing bore 158 during the flow testing procedure.

If additional flow area is needed for the formation fluids, this can be provided by providing one or more of the supplemental equalizing valves 132 which are simply threaded into place on the lower end 134 of lower mandrel 56A prior to attaching the bar pressure vent valve 168.

Further additional flow area can be provided with the bar pressure vent valve which has a flow port therein which can be opened by dropping of an actuating bar down the tubing string 148 in a known manner.

One advantage of a test string which actuates the pressure actuated firing mechanism 170 purely with tubing pressure rather than with an increase in pressure in the upper well annulus 162 as occurs for example in McMahan U.S. Pat. No. 4,915,171 and in Wesson et al. U.S. Pat. No. 4,804,044, is that more flexibility is allowed in using changes in pressure in the upper well annulus 162 for operating other tools such as the tester valve 160, the safety circulating valve 164, and perhaps an annulus pressure responsive circulating valve (not shown) which will also often be present.

The bypass valve means 90 can be generally described as a means for communicating the lower well portion 178 below packing element 121 with the tubing bore 158. The bypass valve means 90 is operably associated with the remainder of the packer 10A so that the bypass valve means 90 is open prior to setting the packer 10A and so that the bypass valve means 90 is closed as the packer 10A is set.

Another function of the bypass valve means 90 is that it provides continuous unimpeded balance between tubing pressure and well pressure exterior of the packer apparatus 10A so as to prevent the possibility of premature actuation of the pressure actuated firing mechanism 170 as the test string 148 is run into the well 150. This allows the firing mechanism 170, if desired, to be one that operates on the differential between tubing pressure and lower annulus pressure, such as Vann Systems' Differential Firing Head shown in Vann Systems brochure TCP-1020.

The one-way equalizer valve means 92 can be described as a means for allowing one-way fluid flow from the lower well portion 178 to the tubing bore 158. The equalizer valve means 92 can be described as being operably associated with the bypass valve means 90 so that the equalizer valve means 92 is inoperable when the bypass valve means 90 is open, and so that the equalizer valve means 92 is operable when the bypass valve means 90 is closed. The one-way equalizer valve means 92 also provides a means for permitting underbalanced perforating of the subsurface formation 180 of well 150 with the perforating gun 172. It further provides a means for permitting tubing pressure actuation of the firing mechanism 170 without pressurizing the lower well zone 178 below the packing element Further, the one-way equalizer valve means 92 permits tubing pressure actuation of the firing mechanism 170 even if there are pre-existing perforations in the well 150 below the packing element 121.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the present invention as defined by the appended claims.

What is claimed is:

1. A packer apparatus for sealing between a tubing string and a well bore of a well, comprising:

a packer body assembly;

a compression packer element disposed about said packer body assembly;

an actuating mandrel means, reciprocably received in said packer body assembly, for expanding said compression packer element to seal against said well bore when weight from said tubing string is set down on said actuating mandrel means, said actuating mandrel means having a central flow passage defined therethrough adapted to be communicated with a tubing bore of said tubing string and having an actuating mandrel port communicated with said central flow passage;

one-way equalizer valve means for allowing one-way fluid flow from said well below said compression packer element to said central flow passage means to equalize well pressure and tubing pressure, said one-way equalizer means including a valve housing having a valve housing bore defined therethrough with said actuating mandrel means being slidably received in said valve housing bore, said valve housing having an equalizer valve port defined therein;

seal means for sealing between said valve housing bore and said mandrel means above said equalizer valve port; and said actuating mandrel means being slidable between upper and lower positions relative to said valve housing, said upper position having said actuating mandrel pot located above said seal means so that said equalizing valve means is inoperable, and said lower position having said actuating mandrel port located below said seal means so that said equalizing valve means is operable and well fluid can flow through said equalizer valve port and then through said actuating mandrel port into said central flow passage.

2. The apparatus of claim 1, wherein:

said one-way equalizer valve means provides a means for permitting underbalanced perforating of said well with a tubing conveyed perforating gun suspended below said packer apparatus.

3. The apparatus of claim 2, wherein:

said one-way equalizer valve means provides a means for permitting tubing pressure actuation of a firing mechanism for said perforating gun without pressurizing said well below said compression packer element.

4. The apparatus of claim 3, wherein:

said one-way equalizer valve means provides a means for permitting tubing pressure actuation of said firing mechanism even if there are existing perforations in said well below said compression packer element.

5. The apparatus of claim 1, wherein:

said one-way equalizer valve means includes an annular elastomeric flapper valve.

6. The apparatus of claim 1, further comprising:

a well fluid bypass passage means defined in said packer body assembly for communicating said well below said compression packer element with said well above said compression packer element prior to setting said packer apparatus to seal said compression packer element against said well bore; and well fluid bypass closure valve means for closing said well fluid bypass passage means when said packer apparatus is set to seal said compression packer element against said well bore.

7. A packer apparatus for sealing between a tubing string and a well bore of a well, comprising:

a packer body assembly;

a compression packer element disposed about said packer body assembly;

an actuating mandrel means, reciprocably received in said packer body assembly, for expanding said compression packer element to seal against said well bore when weight from said tubing string is set down on said actuating mandrel means, said actuating mandrel means having a central flow passage defined therethrough adapted to be communicated with a tubing bore of said tubing string;

one-way equalizer valve means, operably associated with said actuating mandrel means, for allowing one-way fluid flow from said well below said compression packer element to said central flow passage means to equalizer well pressure and tubing pressure;

bypass valve means or communicating said well below said compression packer element with said central flow passage of said actuating mandrel means and thus with said tubing bore, said bypass valve means being operably associated with said actuating mandrel means so that said bypass valve mans is open prior to setting said packer apparatus to seal said compression packer element against said well bore and so that the bypass valve means closes as said packer apparatus is set to seal said compression packer element against said well bore; and wherein said one-way equalizer valve means allows one-way fluid flow from said well below said compression packer element to said central flow passage of said actuating mandrel means only after weight is set down on said packer apparatus.

8. The apparatus of claim 7, wherein:

said bypass valve means includes a bypass valve housing having a bypass valve housing bore therethrough and having a bypass valve port for communicating said bypass valve housing bore with said well;

said one-way equalizer valve means includes an equalizer valve housing having an equalizer valve port disposed therein for communicating with said well; and said actuating mandrel means is received through said bypass valve housing bore and includes a mandrel port which communicates with said bypass valve port when said bypass valve means is open, and which communicates with said one-way equalizer valve means when said bypass valve means is closed.

9. The apparatus of claim 8, wherein:

said equalizer valve port is located below said bypass valve port.

10. A test string for testing a well, comprising:

a tubing string having a tubing bore;

an annulus pressure responsive tester valve disposed in said tubing string;

a tubing conveyed perforating gun disposed in said tubing string below said tester valve, said perforating gun including a tubing pressure actuated time delay firing mechanism; and a compression set packer disposed in said tubing string between said tester valve and said perforating gun, said packer including:

a bypass valve means for communicating said well below said packer with said tubing bore, said bypass valve means being operably associated with said packer so that said bypass valve means is open prior to setting said packer and so that said bypass valve means is closed as said packer is set; and one-way equalizer valve means for allowing one-way fluid flow from said well below said packer to said tubing bore, said equalizer valve means being operably associated with said bypass valve means so that said equalizer valve means is inoperable when said bypass valve means is open, and so that said equalizer valve means is operable when said bypass valve means is closed.

11. The test string of claim 10, wherein:

said one-way equalizer valve means provides a means for permitting underbalanced perforating of said well with said perforating gun.

12. The test string of claim 10, wherein:

said one-way equalizer valve means provides a means for permitting tubing pressure actuation of said firing mechanism without pressurizing said well below said packer.

13. The test string of claim 10, wherein:

said one-way equalizer valve means provides a means for permitting tubing pressure actuation of said firing mechanism even if there are existing perforations in said well below said packer.

14. The apparatus of claim 10, wherein:

said one-way equalizer valve means includes an annular elastomeric flapper valve.

15. A method of perforating and testing a well, said method comprising:

(a) running a test string into said well, said test string including:

a tubing string having a tubing bore;

an annulus pressure responsive tester valve disposed in said tubing string;

a tubing conveyed perfection gun disposed in said tubing string below said tester valve, said perforating gun including a tubing pressure actuated time delay firing mechanism; and a compression set packer disposed in said tubing string between said tester valve and said perforating gun, said packer including:

a bypass valve means or communicating said well below said packer with said tubing bore, said bypass valve means being operably associated with said packer so that said bypass valve means is open prior to setting said packer and so that said bypass valve means is closed as said packer is set; and one-way equalize valve means for allowing one-way fluid flow from said well below said packer to said tubing bore, said equalizer valve means being operably associated with said bypass valve means so that said equalizer valve means is inoperable when said bypass valve means is open, and so that said equalizer valve means is operable when said bypass valve means is closed;

(b) setting down weight on said tubing string and thereby setting said compression set packer to isolate an upper well annulus from a lower portion of said well;

(c) increasing well fluid pressure in said upper well annulus and thereby opening said annulus pressure responsive tester valve;

(d) increasing tubing fluid pressure in said tubing bore down through said tester valve and thereby actuating said firing mechanism without increasing well fluid pressure in said lower portion of said well;

(e) after step (d), reducing tubing fluid pressure in said tubing bore down through said tester valve and equalizing well fluid pressure in said lower portion of said well with said reduced tubing fluid pressure through said one-way equalizer valve means;

(f) after step (e), firing said perforating gun to perforate said lower portion of said well to communicate a subsurface hydrocarbon producing formation with said well in an underbalanced condition.

16. An adapter for connecting a tubing conveyed perforating string to a drill stem test string, said adapter comprising:

a bypass valve housing having a bypass valve housing bore defined therethrough and having a bypass port communicating said housing bore with an exterior of said bypass valve housing;

an equalizer valve housing connected to a lower end of said bypass valve housing, and having an equalizer valve housing bore defined therethrough and aligned with said bypass valve housing bore, said equalizer valve housing having an enlarged counterbore located above said equalizer housing bore and below said bypass valve housing bore, said equalizer valve housing having an equalizer port communicating said enlarged counterbore with an exterior of said equalizer valve housing;

an actuating mandrel extension closely received in said bypass valve housing bore and said equalizer valve housing bore, said actuating mandrel extension having a mandrel bore therethrough and having a mandrel port communicating said mandrel bore with a cylindrical exterior surface of said packer mandrel extension;

an annular elastomeric flapper valve disposed in said enlarged counterbore of said equalizer valve housing to prevent outward flow through said equalizer port;

upper and lower annular seals between said cylindrical exterior surface of said actuating mandrel extension and said bypass valve housing bore and said equalizer valve housing bore, respectively; and wherein said actuating mandrel extension is longitudinally movable between a first position wherein said mandrel port is located above said upper seal and is communicated with said bypass port, and a second position wherein said mandrel port is located between said upper and lower seals and is communicated with said flapper valve.

* * * * *